United States Patent [19]

Whitchurch

[11] 4,224,748

[45] Sep. 30, 1980

[54] SHOE SOLE

[75] Inventor: Raymond Whitchurch, Sullivan, Mo.

[73] Assignee: Meramec Industries, Inc., Sullivan, Mo.

[21] Appl. No.: 23,159

[22] Filed: Mar. 23, 1979

[51] Int. Cl.[2] ..... A43B 13/28; A43B 13/37; A43B 23/22

[52] U.S. Cl. ..... 36/24.5; 36/30 R; 36/34 A; 36/76 R

[58] Field of Search ..... 36/24.5, 30 R, 32 R, 36/34 A, 25, 76 R; 12/142 J

[56] References Cited

U.S. PATENT DOCUMENTS

| | | | |
|---|---|---|---|
| 1,753,702 | 4/1930 | Griffiths | 36/30 R |
| 2,016,178 | 10/1935 | Riddock | 36/32 R |
| 2,729,618 | 1/1956 | Müller et al. | 36/34 A |
| 3,057,087 | 10/1962 | Gudermuth | 36/34 A |
| 3,188,302 | 6/1965 | Lorenz | 36/34 A |

FOREIGN PATENT DOCUMENTS

| | | | |
|---|---|---|---|
| 806335 | 6/1951 | Fed. Rep. of Germany | 36/32 R |
| 838413 | 5/1952 | Fed. Rep. of Germany | 36/25 |

*Primary Examiner*—James Kee Chi

[57] ABSTRACT

The invention relates to an injection molded, raised heel, shoe sole structure of improved strength characteristics. The shoe sole consists of (i) a unitary shoe sole member comprising a raised heel, a foot supporting member and a shank portion connecting the heel and the foot supporting member; (ii) a toplift member positioned on the terminal portion of the raised heel of the sole member; and (iii) a free-standing metallic support member embedded within the full length of the heel and a portion of the shank portion of the sole member. The toplift member is attached to and supported by a free end of the metallic support member.

3 Claims, 1 Drawing Figure

SHOE SOLE

BACKGROUND OF THE INVENTION

Field of the Invention

The present invention relates to an improved raised heel, shoe sole structure of improved strength characteristics. More particularly, the invention is concerned with an injection molded, raised heel, shoe sole structure having a free-standing metallic support member embedded within the shoe sole structure.

SUMMARY OF THE INVENTION

The raised heel, shoe sole structure of the present invention comprises three principal elements; namely, a unitary sole member having a raised heel, a toplift member positioned on the terminal portion of the heel and a continuous metallic support member embedded within the sole member and attached to the toplift member. The metallic support member provides strength and rigidity to the total shoe sole structure.

DESCRIPTION OF THE PREFERRED EMBODIMENT

Figure 1:
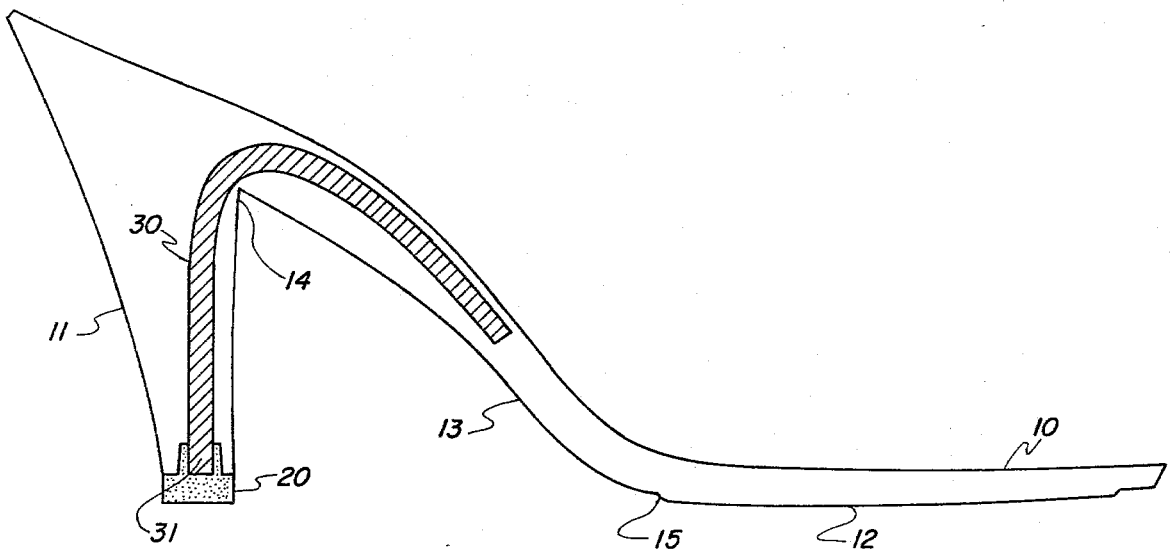
FIG. 1 is a cross-sectional view of the raised heel, shoe sole structure of the present invention.

Referring to FIG. 1, the shoe sole structure comprises a unitary sole member 10 comprising a raised heel 11, a generally horizontally disposed foot supporting member 12 and a shank portion 13 that connects the heel and supporting member. The sole member 10 is a unitary article formed from a synthetic organic polymer preferably using injection molding techniques. However, extrusion molding, or polyurethane foam molding techniques may be used. The shank portion 13 of the unitary sole member 10 extends from the forwardmost portion of heel 11 (point 14) to the rearmost portion (point 15) of foot supporting member 12.

The second element of the shoe sole structure of the invention is a toplift member 20. The toplift member 20 is positioned on and substantially covers the terminal portion of heel 11 of sole member 10. The third element of the shoe sole structure of the invention is metallic support member 30. The support member 30 is preferably a unitary, free-standing metallic member and is embedded within the full length of the heel 11 of the sole member and extends within a portion of the length of shank member 13. Preferably, the metallic support member 30 extends at least about 50% of, preferably 50 to 80% of, the length of the shank portion 13 of the sole member 10. Toplift member 20 is attached to and supported by a free end 31 of the metallic support member 30. The mode of attachment of the toplift member 20 to the support member 30 is not critical. A force fit of the toplift member onto the support member 30 is an adequate arrangement.

The unitary sole member, as noted above, is formed from a synthetic organic polymer, preferably using injection molding techniques. The material used in the fabrication of the unitary sole member is not critical. For example, the sole member may be formed from polyurethane materials or thermoplastic elastomers, that is, a material that possesses both thermoplastic and elastomeric properties. One useful type of thermoplastic elastomer is a material sold under the trademark Kreton. In contrast, the toplift member 20 should be formed from a tough, rigid material that has shock-absorbing and vibration-dampening properties. It is preferred that the toplift member be formed from a thermoplastic polyurethane that has a Shore A hardness of at least about 85. The metallic support member 30 is preferably formed from spring steel and will normally possess a cross-sectional area varying from about 0.004 to about 0.04 square inches, and preferably about 0.015 square inches.

The unitary shoe sole structure of the present invention is preferably formed by first injection molding the toplift element from a thermoplastic polyurethane and then attaching the same to a free end of the generally U-shaped metallic support member. The metallic support member with toplift member attached is then placed into a conventional mold and the desired polymeric material injected into the mold to encompass the metallic support member 30 and that portion of toplift 20 that may be employed to form an attachment between support member 30 and toplift member 20.

What is claimed is:

1. A raised heel, shoe sole structure comprising:

(a) a unitary sole member formed from a synthetic organic polymer and comprising a raised heel, a generally horizontally disposed foot supporting member and a shank portion connecting said heel and foot supporting member;

(b) a toplift member positioned on the terminal portion of the heel of said sole member; and (c) a unitary, free-standing metallic support member having a cross-sectional area varying from about 0.004 to about 0.04 square inches embedded within the full length of the heel of said sole member and for at least about 50% of the length of the shank portion of the sole member, said toplift member attached to and supported by a free end of said metallic support member.

2. The article of claim 1 wherein said toplift member is formed from a thermoplastic polyurethane having a Shore A hardness of at least about 85.

3. The article of claim 2 wherein said metallic support member is formed from spring steel.

* * * * *